US008356456B2

(12) United States Patent
Floding et al.

(10) Patent No.: US 8,356,456 B2
(45) Date of Patent: Jan. 22, 2013

(54) APPARATUS FOR ADJUSTABLE WRAPPING

(75) Inventors: Daniel L. Floding, Alexandria, MN (US); Richard W. Lukanen, Jr., Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 362 days.

(21) Appl. No.: 12/717,597

(22) Filed: Mar. 4, 2010

(65) Prior Publication Data

US 2011/0214397 A1 Sep. 8, 2011

(51) Int. Cl.
*B65B 11/02* (2006.01)

(52) U.S. Cl. ..... 53/218; 53/210; 53/465

(58) Field of Classification Search ..... 53/218, 53/210, 588, 589, 465
See application file for complete search history.

(56) References Cited

U.S. PATENT DOCUMENTS

| | | | | |
|---|---|---|---|---|
| 4,277,731 | A | 7/1981 | Pongracz | |
| 4,590,746 | A * | 5/1986 | Humphrey | 53/556 |
| 4,628,667 | A * | 12/1986 | Humphrey et al. | 53/399 |
| 4,912,911 | A * | 4/1990 | Down | 53/465 |
| 5,027,581 | A | 7/1991 | Kovacs | |
| 5,168,801 | A | 12/1992 | Switek, Jr. | |
| 5,170,612 | A | 12/1992 | Sumino | |
| 5,203,146 | A | 4/1993 | Gambetti | |
| 5,285,891 | A | 2/1994 | Keip | |
| 5,850,726 | A | 12/1998 | Degrasse et al. | |
| 5,996,314 | A | 12/1999 | Pennini et al. | |
| 6,065,269 | A * | 5/2000 | Malnati | 53/176 |
| 6,393,808 | B1 * | 5/2002 | Kallner et al. | 53/556 |
| 6,474,041 | B1 | 11/2002 | Gambetti | |
| 6,594,970 | B1 * | 7/2003 | Hyne et al. | 53/399 |
| 6,739,115 | B1 | 5/2004 | Malini | |
| 6,938,397 | B2 | 9/2005 | Miller | |
| 6,964,147 | B2 | 11/2005 | Gambetti | |
| 7,849,770 | B2 * | 12/2010 | Floding et al. | 83/42 |

(Continued)

FOREIGN PATENT DOCUMENTS

| | | | |
|---|---|---|---|
| DE | 29608343 | U1 | 10/1997 |
| DE | 10037714 | C1 | 1/2002 |

(Continued)

OTHER PUBLICATIONS

Douglas Machine, Model SR3 Shrink Wrapping Systems Flyer, Jun. 1997.

(Continued)

*Primary Examiner* — Sameh H. Tawfik
(74) *Attorney, Agent, or Firm* — Nawrocki, Rooney & Sivertson, P.A.

(57) ABSTRACT

A wrapping apparatus, system, station and/or process is generally provided. As to the apparatus, it includes a wrap bar for engaging and directing a wrapper about the product, a wrap bar carrier from which the wrap bar extends, and a drive assembly operatively linked to the wrap bar carrier. The carrier block, which translatingly retains the carrier intermediate opposing end portions thereof, is adapted for driven rotation about a wrapping axis of the apparatus so as to thereby rotatingly drive the bar about the axis via rotation of the carrier. The drive assembly, which is operatively linked to the carrier, selectively translates the carrier in relation to the carrier block during driven rotation of the carrier such that a radial distance for the bar from the axis is thereby capable of selective establishment in furtherance of delimiting a wrap bar travel path commensurate with the product profile of the product.

27 Claims, 6 Drawing Sheets

U.S. PATENT DOCUMENTS

| | | | |
|---|---|---|---|
| 2004/0083689 | A1 | 5/2004 | Floding et al. |
| 2007/0289253 | A1 | 12/2007 | Miller |

FOREIGN PATENT DOCUMENTS

| | | | |
|---|---|---|---|
| EP | 0581747 | A1 | 2/1994 |
| EP | 1013551 | A2 | 6/2000 |
| EP | 1013552 | A1 | 6/2000 |
| WO | WO-9112176 | A1 | 8/1991 |

OTHER PUBLICATIONS

Douglas Machine, Model SR4 Shrink Wrapping Systems Flyer, Apr. 1996.

Douglas Machine, Model SR7 Shrink Wrapping Systems Flyer, Apr. 1996.

Douglas Machine, Model SR10 Shrink Wrapping Systems Flyer, Apr. 1996.

Douglas Machine, Model SR50 Shrink Wrapping System Flyer, Nov. 1994.

Douglas Machine, Model SR60/Model SR100 Shrink Wrapping Systems Flyer, Nov. 1994.

Douglas Machine, SR Series Single-Roll Shrink-Wrappers Flyer, Oct. 2000.

Copenheaver, Blaine R., PCT International Search Report and Written Opinion of the International Searching Authority, PCT Application No. PCT/US11/26178, Apr. 29, 2011.

* cited by examiner

APPARATUS FOR ADJUSTABLE WRAPPING

TECHNICAL FIELD

The present invention generally relates to the field of packaging, more particularly, to any or all of apparatus, systems, and processes, to aid product wrapping, and more particularly still, to apparatus, systems, and processes for wrapping a wide variety of products characterized by a wide variety of product profiles, for example and without limitation, any and all of cans, bottles, jars, cartons, trays, etc.

BACKGROUND OF THE INVENTION

Sleeve type wrapping stations are commonly part and parcel of automated packaging systems, namely, those characterized by the conveyance of product, usually, but not necessarily, an aggregation of discrete product elements, e.g., cans, bottles, jars, cartons, trays, etc. which are to be wrapped in furtherance of consolidating or securing the aggregation as a bundle or the like. Generally, conveyed product is received upon a conveyor of a wrapping station, with a leading edge of a wrapper or wrapping (i.e., a film sheet or the like), fed from below, interposed between the station conveyor and the product. Thereafter, a wand or wrap bar, which "orbits" or circumscribes so as to travel about the station conveyor (i.e, the wand, in looping fashion, ascends from below the leading edge of the station conveyor, travels over the length of the conveyor, and descends below the trailing edge of the station conveyor), engages the wrapper or wrapping, and directs it over and about the product. Upon exiting the wrapping station, a sleeved product proceeds for further processing, commonly, processing to effectuate a "shrinking" of the wrapper sleeve so as to bundle or otherwise secure the product so sleeved.

Characteristic of heretofore known sleeve type wrapping stations is a wand track and track follower. Notionally, a travel path for, or orbit of, the wand or wrap bar is delimited by a track, with the wand at least indirectly equipped with a track mating follower (see e.g., Gambetti (U.S. Pat. Nos. 6,474,041 & 6,964,147, and EP 1013552 A1), and Floding et al. (U.S. Pub. No. 2004/0083689)). In connection to the latter teaching, an earlier filing of Applicant's incorporated herein by reference in its entirety, shortcomings were identified and discussed with regard to chain driven wand paths and those delimited by cam tracks/cam followers, for instance and without limitation, an inability to easily, efficiently and economically accommodate the effective processing of greater than one product batch (i.e., provide apparatus or methods that are adjustable to accommodate a large range of product profiles, e.g., a first batch run of 2×2 arrays of 1 liter bottles followed by a second batch run of 6×4 arrays of 8 ounce cans).

With a cam track formed of or from a plurality of cam segments readily interchangeable to define different shapes for the continuous path of a wrap support which engages and directs the sheet wrapper, Floding et al. enhanced automated packaging operations. While the disclosed cam track approach generally, and cam segment approach specifically, alone or in combination with, among other things, a slave driven conveyor table proved advantageous in furtherance of enhancing previously known automated packaging operations, it is believed that further improvement with regard to function so as to more quickly and efficiently process products of varied product profiles remain outstanding and attainable.

For example, and in contradistinction to chain drives, while the cam track approach generally permits advantageous select velocity and acceleration changes for the wand during its orbit, inherent practical limitations exist owing to the interface of the track follower with the cam track. Moreover, the noted inherent practical limitations further limit the overall processing speed or indwelling time of product at or within the wrapping station (i.e., the period of the orbit).

It has been found that advantageous cam track configurations or layouts corresponding to widely or commonly seen product profiles result in high pressure angle forces on the cam followers in the cam tracks or cam track portions. Moreover, and as should be readily appreciated, synchronous travel of opposing wand ends via their indirect travel upon opposing cam tracks is essential, with the wrapper station conveyor table support structure(s) not to be overlooked and/or undervalued with regard to that objective.

Further still, operator intervention in the form of a physical change out or change over of station components remains a necessity to accommodate the processing of a wide range of products intended for processing. In as much as improvements have been made to reduce down time associated with batch processing, continuous processing of a variable and varying product feed to a wrapping station remains as an important objective.

Thus in light of the foregoing, provisions for continuous wrap station operation via a given, mechanically fixed wrap station which readily processes and is inherently responsive to variable batch feeds of product (i.e., product batches each having a characteristic product profile relating to product height) for wrapping is believed desirable and advantageous. Furthermore, greater orbit path precision and speed., and smoother wand motion via orbit travel is believed desirable and advantageous. Further still, provisions for an improved wrapper station conveyor table support structure, for example, a unitary table support, is believed desirable and advantageous.

SUMMARY OF THE INVENTION

A wrapping apparatus, system, station and/or process of or for wrapping a product characterized by a product profile is generally provided.

As to the apparatus, it advantageously includes a wrap bar for engaging and directing a wrapper about the product, a wrap bar carrier from which the wrap bar extends, and a drive assembly operatively linked to the wrap bar carrier. The carrier block, which retains the translating wrap bar carrier intermediate opposing end portions thereof, is adapted for driven rotation about a wrapping axis of the apparatus so as to thereby rotatingly drive the wrap bar about the wrapping axis via rotation of the wrap bar carrier. The drive assembly, which is operatively linked to the wrap bar carrier, selectively translates the wrap bar carrier in relation to the carrier block during driven rotation of the wrap bar carrier such that a radial distance for the wrap bar from the wrapping axis is thereby capable of selective establishment in furtherance of delimiting a wrap bar travel path commensurate with the product profile of the product.

An alternate non-limiting wrapping station for automated sheet wrapping of a conveyed product is further contemplated. More particularly, an apparatus characterized by a wrap supporting member, opposingly paired, spaced apart elongate wrap bar carriers, and opposingly paired, spaced apart, and synchronously rotatable retainers. Advantageously, the wrap supporting member is exclusively supported by corresponding free end portions of the opposingly paired elongate wrap bar carriers in furtherance of establishing a trackless travel path for the wrap supporting member about a wrapping axis. Each retainer of the opposingly paired, spaced apart, and synchronously rotatable retainers is adapted for reciprocating retention of each elongate wrap bar carrier of the opposingly paired elongate wrap bar carriers so as to thereby establish a select driven radial position of the wrap support member relative to the wrapping axis during travel of the wrap supporting member along the trackless travel path about the conveyed product.

Finally, a preferred, non-limiting method of wrapping a conveyed product with a sheet wrapper supported by a wrap bar is provided. More particularly, the contemplated wrapping method or process includes orbiting the wrap bar about a wrap axis in furtherance of forming a sheet wrapper sleeve around the conveyed product. Moreover, and advantageously, the method/process includes selectively translating the wrap bar orbiting the wrap axis such that a radial distance for the wrap bar from the wrap axis is thereby capable of selective establishment so as to define a wrap bar path commensurate with a product profile of the conveyed product, with select translation of the wrap bar being accomplished without reliance upon a track/track follower arrangement. More specific features and advantages obtained in view of those features will become apparent with reference to the drawing figures and DETAILED DESCRIPTION OF THE INVENTION.

DETAILED DESCRIPTION OF THE INVENTION

Prior to a description of any apparatus, system or process particulars, some preliminary remarks are in order. More particularly, several functional or operative notions warrant review, and/or previewing as the case may be.

By way of review, generally, a wand or wrapping support element is driven for travel in the direction of product conveyance. Via rotation, such wand, in an side/end view travels a first 180° arcuate path over a product receiving conveyor table and continues through a second 180° arcuate path under or below the table to thus generally define a 360° wand orbit. While circular orbits (i.e., constant radius paths) perhaps serve and have served some product wrapping scenarios well, other orbit profiles, e.g., elliptical or polygonal, require select departures/changes in the elevation of the wand relative to the conveyor table, more particularly in relation to a wrapping mechanism axis of rotation. In summary, known wrapping apparatus, systems and/or processes may be fairly characterized by three motions, first, product conveyance; second, wand rotation; and third, wand translation or reciprocation relative to conveyed product (i.e., radial translation or reciprocation relative to the rotational axis).

By way of preview, fundamentally, an aim of the disclosed and/or contemplated apparatus, systems or processes is to continually receive and process, via an accommodation, e.g., self adjustment of apparatus components, product of sequentially conveyed product wherein the sequentially conveyed product comprises product batches wherein each product batch is characterized by a product profile. For product A having a profile A' designated for wrapping, a wrapper is engaged for support by a wrapping bar which is selectively directed through an orbit or travel path A" up and over product A as it passes through the wrapping station. With the inevitable subsequent processing of product B having profile B', where B' is distinct from A', the wrapping bar is then correspondingly, and on-the-fly, selectively directed through an orbit or travel path B" up an over product B as it passes through the wrapping station.

In lieu of a continued focus with regard to improving slave, track driven wrapping bars, and what is believed a commensurate marginal rate of return in product processing performance, Applicant provides, via an abandonment of anything resembling a track, a wrapping mechanism or apparatus characterized by a mechanically unencumbered yet highly controllable, rotatable and translatable wand or wrap bar. Moreover, such wand or wrap bar path delimited by select rotation and radial translation or reciprocation of the wand or wrap bar is on-the-fly selectable and/or responsive to changing product, with unforeseen speed and control of wrapping operations achieved.

Figure 1:
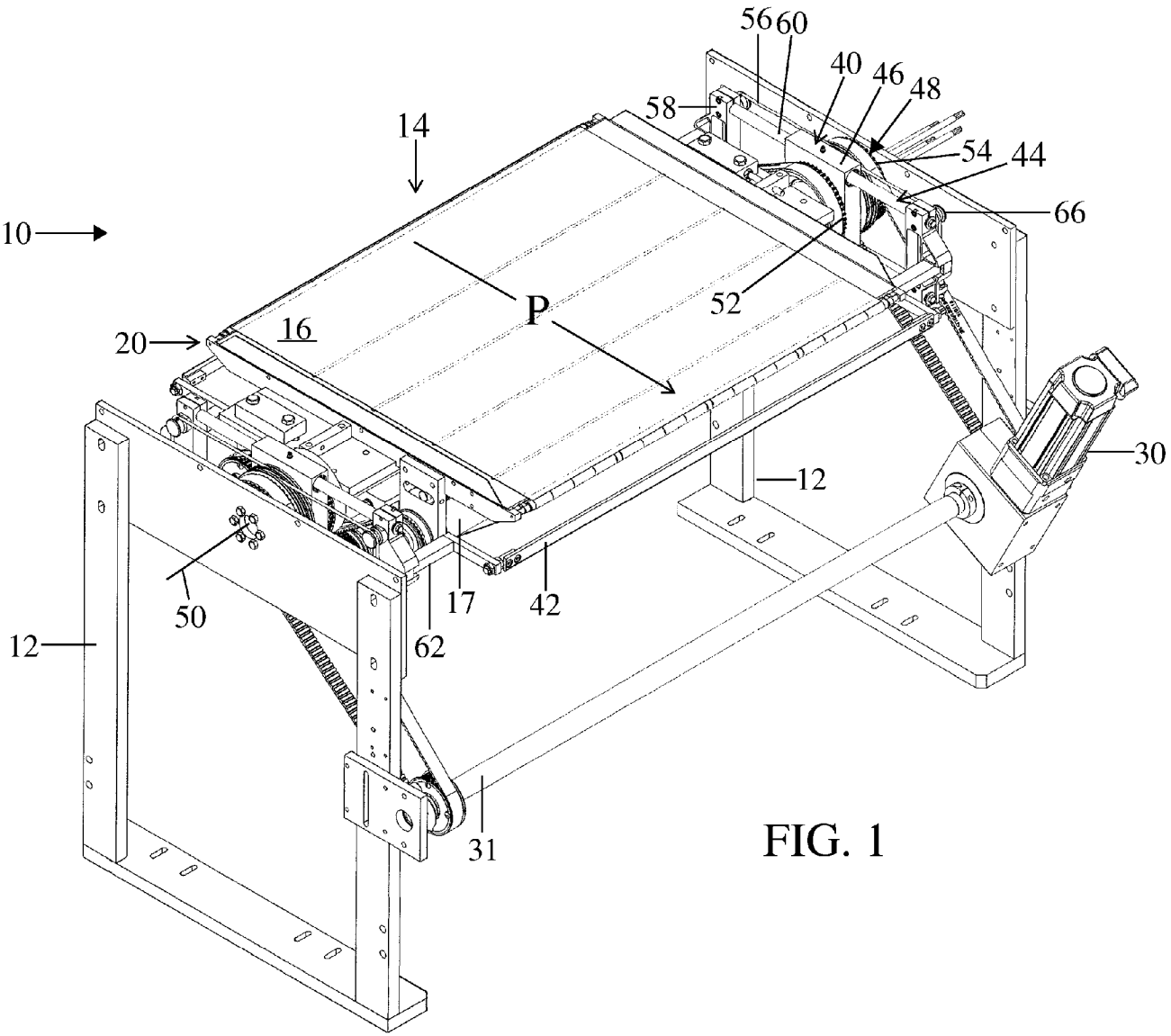
FIG. 1 depicts, in top side perspective, a preferred non-limiting improved wrapping station.
Figure 2:
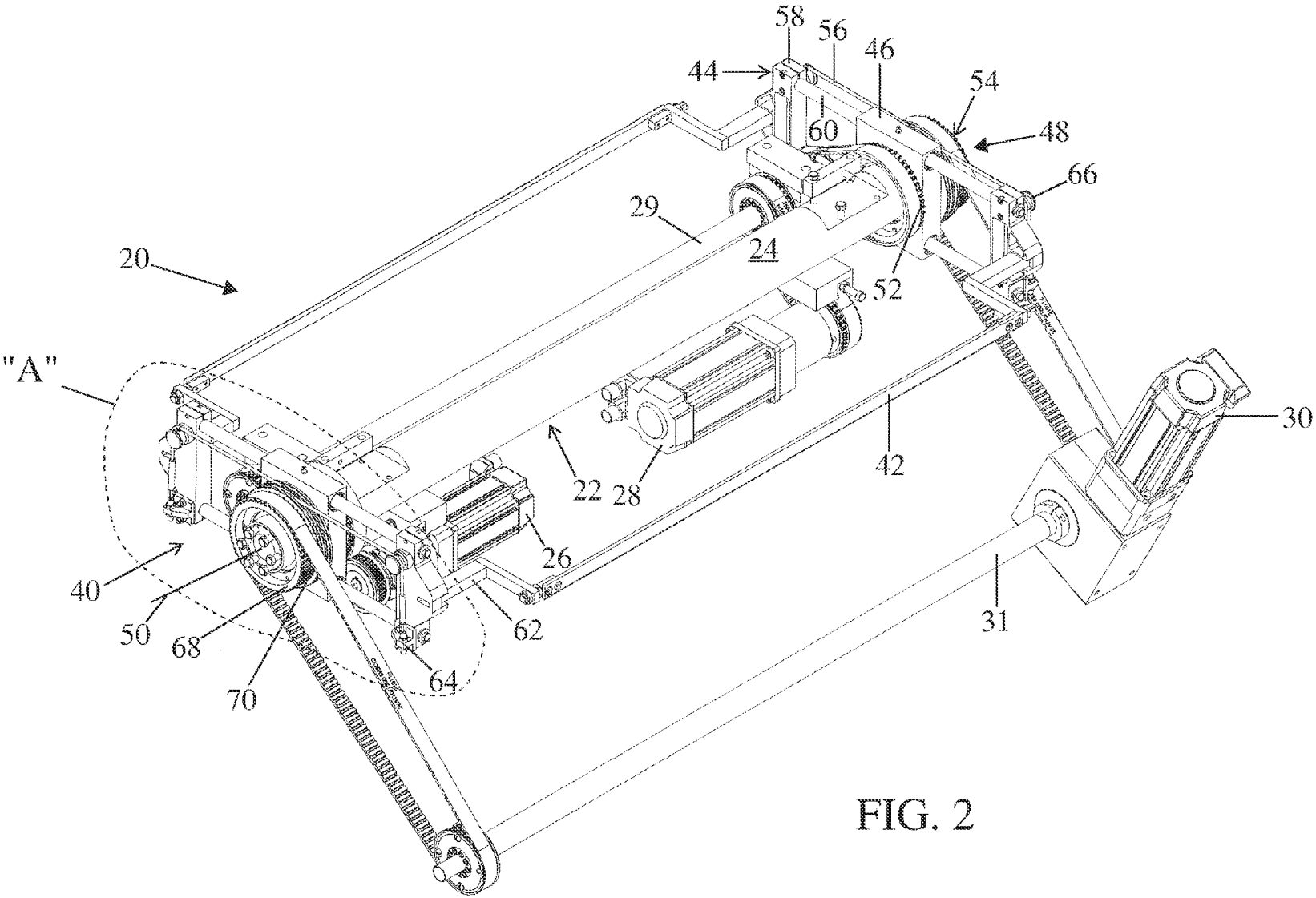
FIG. 2 depicts portions of the wrapping station of FIG. 1, namely a wrapping table or system with elements removed to reveal underlaying particulars and/or for emphasis.
Figure 3:
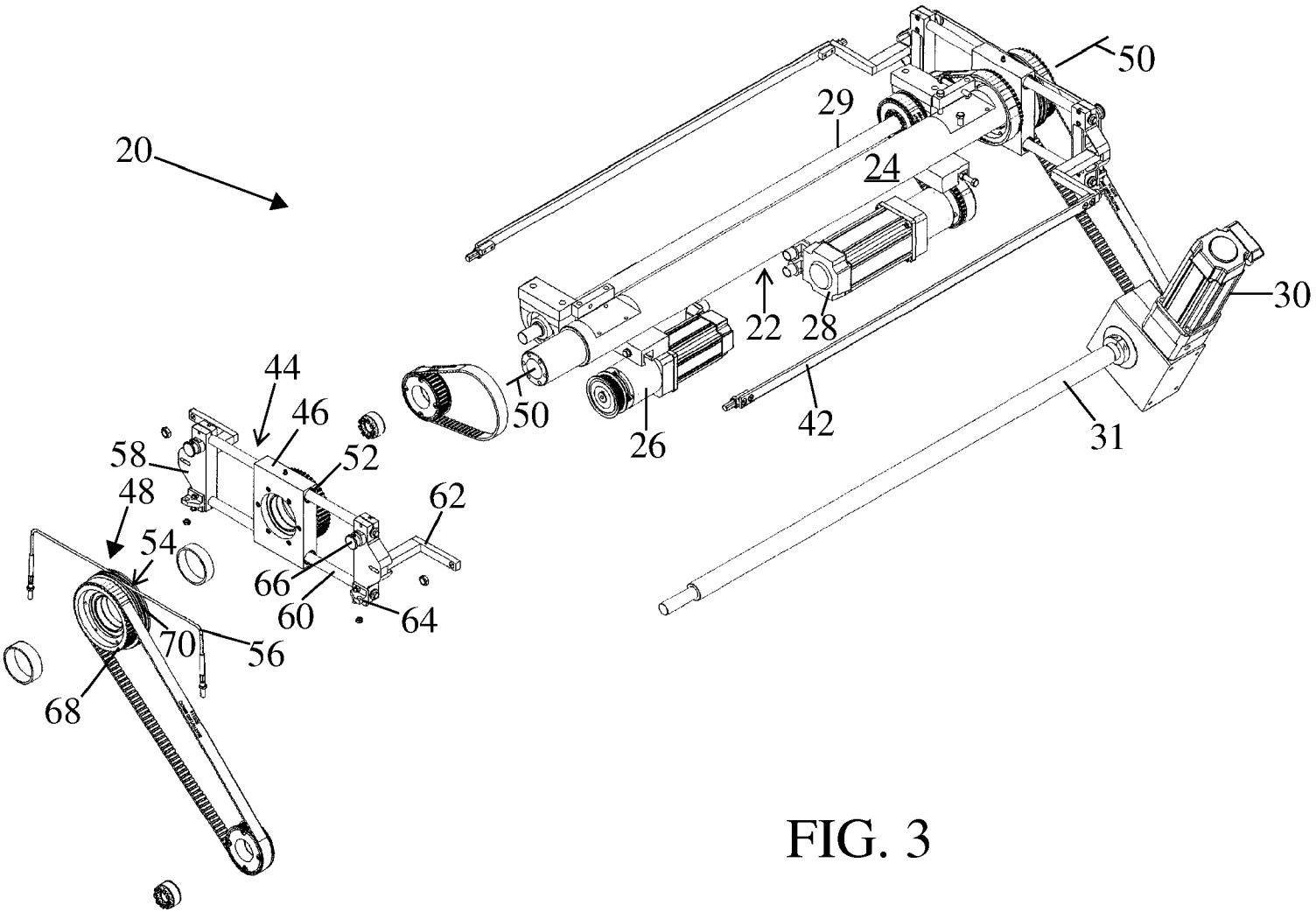
FIG. 3 depicts the wrapping table or system of FIG. 2 in exploded view.
Figure 4:
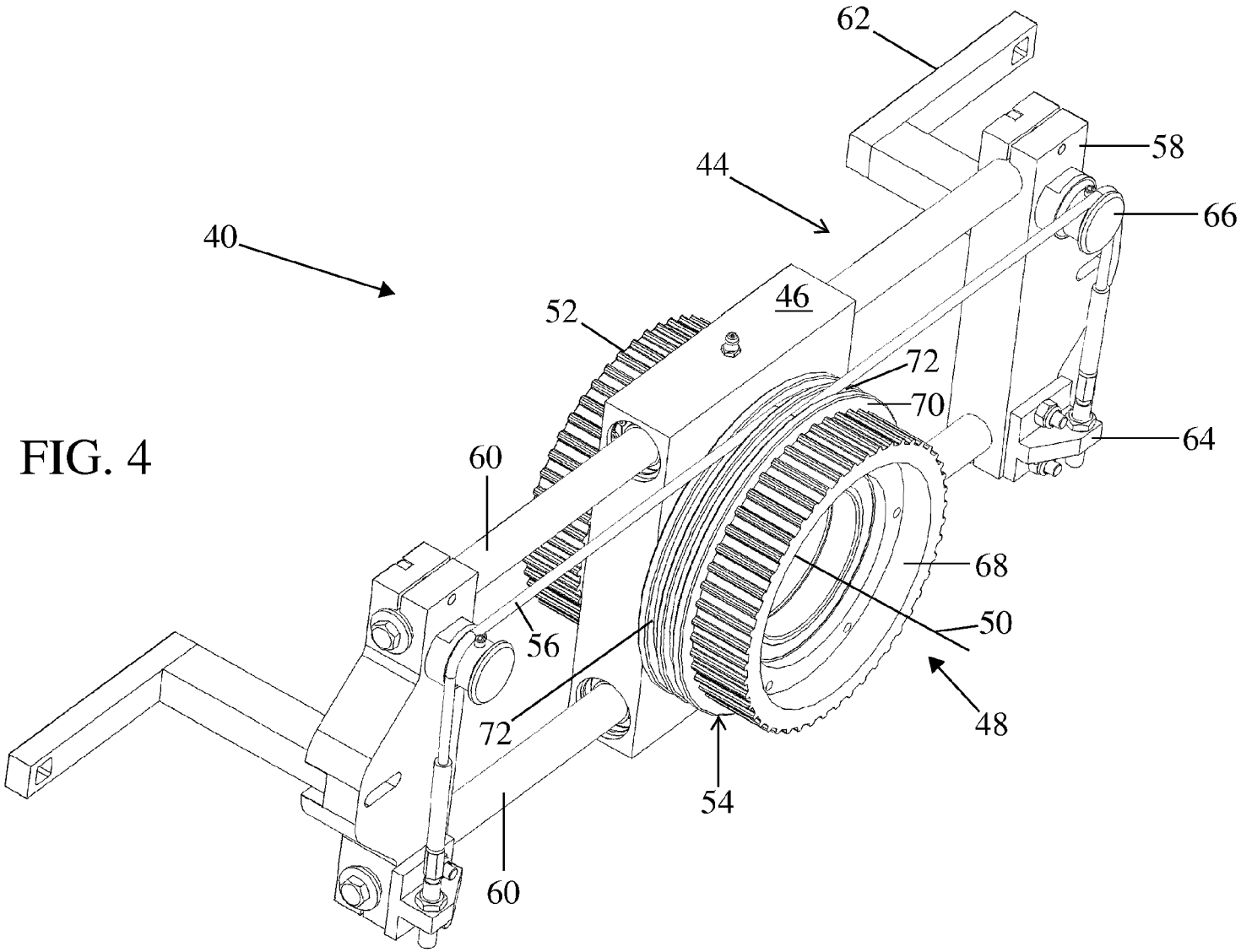
FIG. 4 depicts particulars of area "A" of FIG. 2, rotated left to right, and viewed slightly from above, namely, the wrapping mechanism (driven elements) of the wrapping table or system.
Figure 5:
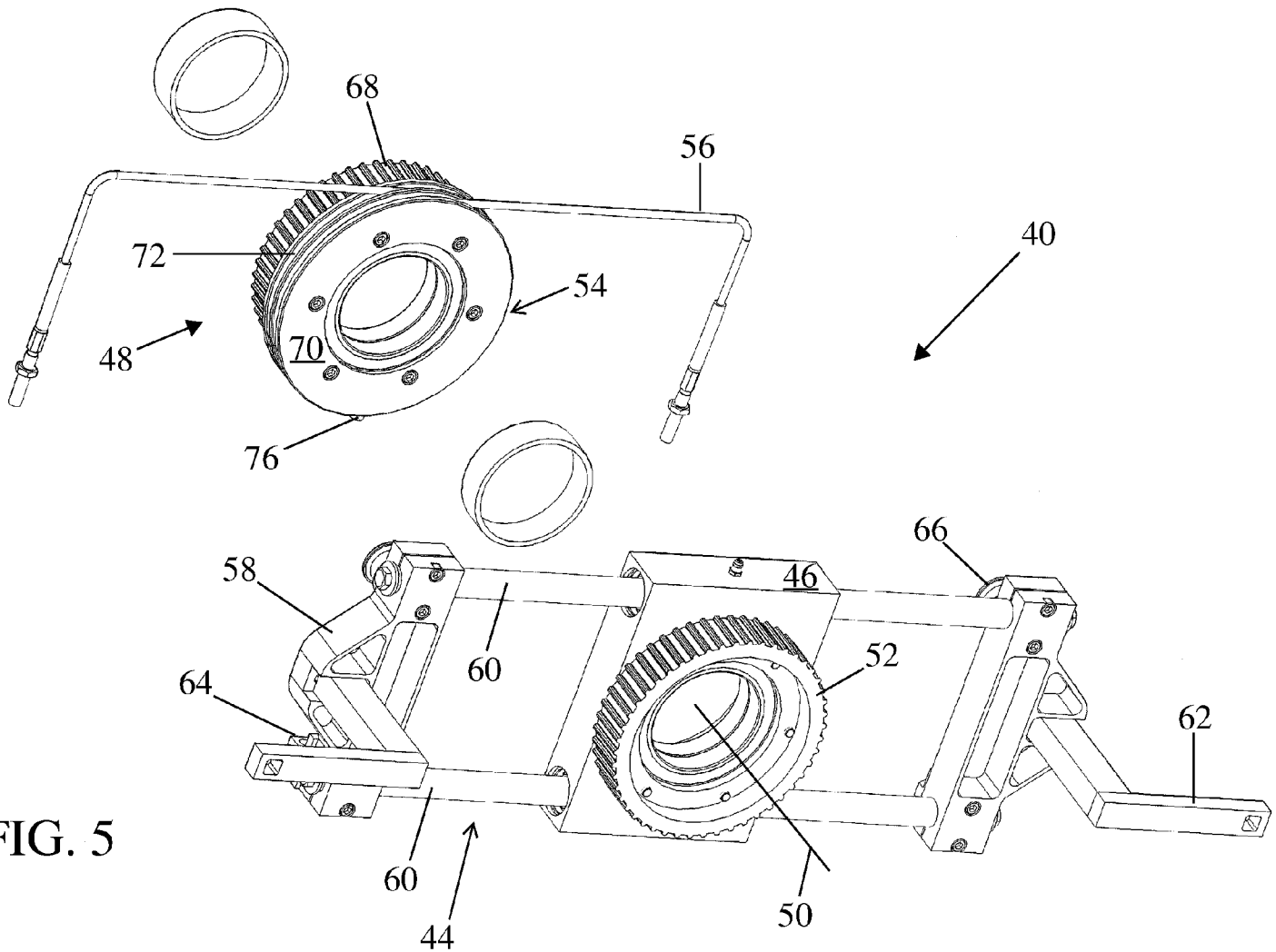
FIG. 5 depicts the wrapping mechanism of FIG. 4, from behind and in exploded view; and, FIG. 6 depicts a view from below (i.e., the underside) of the wrapping mechanism of FIG. 4.
Figure 6:
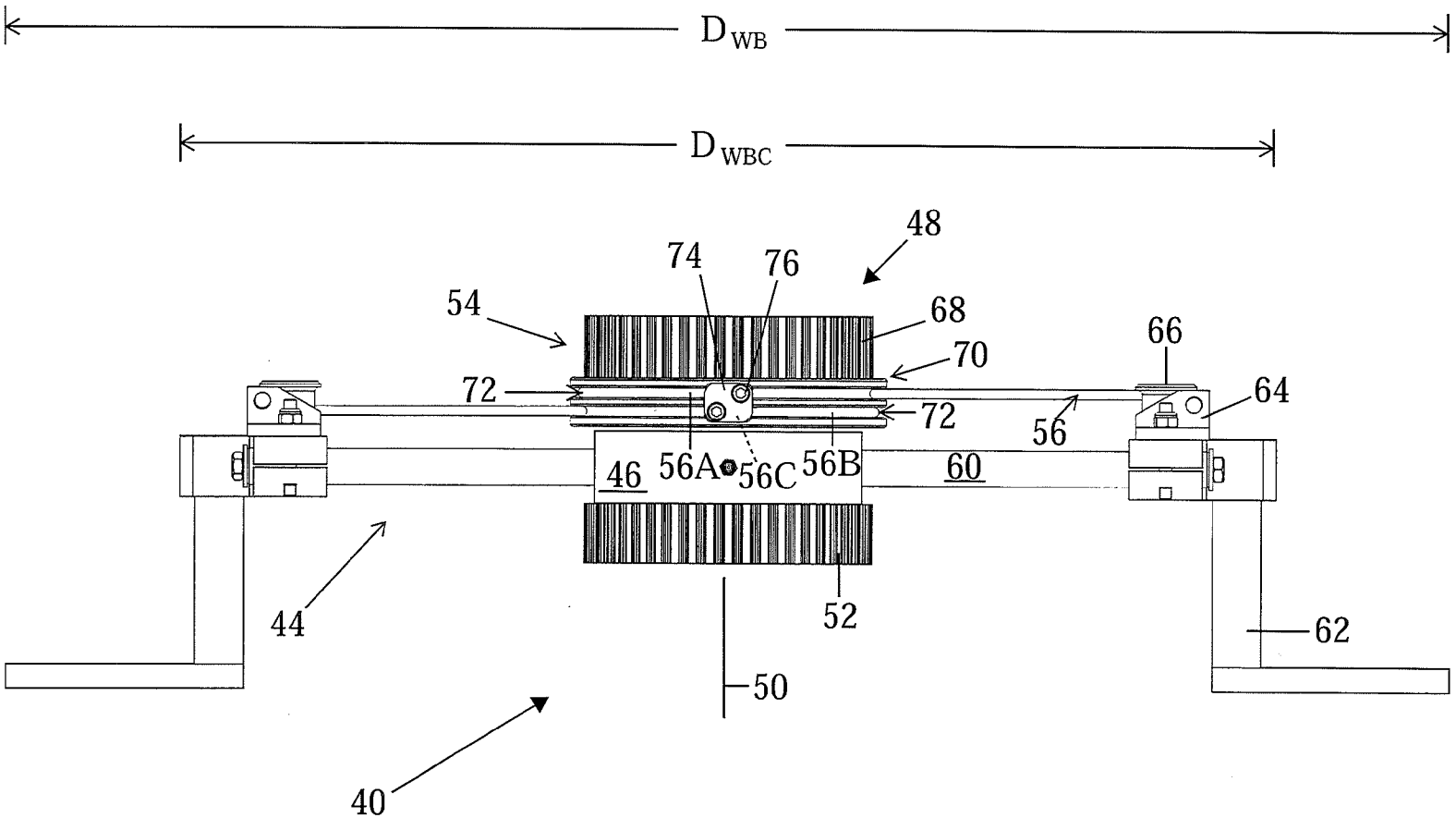

The following description immediately proceeds with general reference to the wrapping station or system of FIGS. 1-3, and thereafter the wrapping apparatus or mechanism of FIGS. 4-6. As should be readily appreciated with reference to, among other things, Floding et al., the wrapping station of FIG. 1 is preferably but not necessarily a turn-key or modular assembly, which in turn is part and parcel of an automated packaging system or operation, such systems and/or operations generally well known and beyond the scope of the instant disclosure.

Referring now generally to FIGS. 1-3, there is depicted in FIG. 1 a preferred, non-limiting improved wrapping station 10. A wrapping table or system 20 of the station of FIG. 1 is depicted in FIG. 2, portions removed, and those remaining portions or elements of the table or system depicted in FIG. 2 shown in the exploded view of FIG. 3.

With specific reference to FIG. 1, generally, a wrapping table or system 20 is operatively supported between opposing frame elements or legs 12. A conveyor system 14 characterized by, among other things, a wrapping conveyor 16, provides for the transport of product "P" through station 10 as indicated. More particularly, the wrapping conveyor 16 receives product from an upstream "first" conveyor (not shown), and transports the sleeve wrapped product so formed, via the wrapping operation, to a downstream "second" conveyor (not shown). As referenced in the background, and as will become apparent as this description proceeds, there exists a gap between the first conveyor and the wrapping conveyor, and a further gap between the second conveyor and the wrapping conveyor to accommodate one or more wands orbiting the wrapping conveyor.

As will be subsequently detailed in connection to FIGS. 4-6, the wrapping apparatus or mechanism 40 of the wrapping station 20 of FIG. 1 is generally and fairly characterized by a wrap engaging and supporting member or element, e.g., a bar 42 as indicated, for engaging and directing a wrapper about the product, a wrap bar carrier 44 from which wrap bar 42 extends, a rotatingly driven or driveable carrier block 46 which slidingly or otherwise retains wrap bar carrier 44 for translation or reciprocation, and a drive assembly 48 operatively linked to wrap bar carrier 44 for selectively positioning wrap bar carrier 44 in relation to carrier block 46 during driven rotation of wrap bar carrier 44. Absent from the assembly is any track/track follower feature (i.e., structure).

In advance of further particulars, it is to be noted that while the balance of this description generally but not exclusively proceeds with regard to the wrapping mechanism of FIGS. 4-6, it should be readily appreciated via reference to FIGS. 1-3 that at least a single wrap bar is advantageously, but not necessarily supported at both its opposing end portions, by opposingly paired wrap bar carriers, more particularly, the FIG. 4-6 wrapping mechanism including same. Moreover, while two opposing wrap bars are depicted extending between opposingly paired wrap bar carriers, the wrapping mechanism need not be so limited, however, the robustness of the depicted arrangement is believed desirable and advantageous.

With particular reference now to FIGS. 2 & 3, there is generally shown in FIG. 2 primary structures of the wrapping table or system of FIG. 1, with the table structures of area "A" thereof depicted in an exploded, disassociated state or condition in FIG. 3. As shown, a table support assembly is provided, more particularly and advantageously, table support assembly 22 characterized by a one piece, full length table support member, namely, a tube 24 as shown. As should be appreciated with reference to FIG. 3, and again to FIG. 1, table support tube 24 spans frame elements 12 for support thereby, and it in turn supports, at each of its opposing ends, wrapping mechanism 40 of FIGS. 4-7, more particularly, carrier block(s) 46 thereof.

In addition to supporting wrapping mechanism 40 (e.g., FIG. 4) and wrapping conveyor 16 (FIG. 1) which is absent from the FIG. 2 depiction, table support member 24, as shown, supports two of the three advantageously dedicated drivers/drive assembly components of the wrapping station. More particularly, a first tube supported driver, namely, a wrapping conveyor driver 26, is operatively linked in a known way as shown (e.g., FIG. 1) to a roller 17 or the like in furtherance of imparting motion to wrapping conveyor 16 of wrapping conveyor system 14, and a second tube supported driver, namely, a carrier block driver 28 is operatively linked, via a common shaft 29, to opposingly aligned carrier blocks 46 in a known way as shown (e.g., FIG. 2) to thereby synchronously rotate each carrier block 46 about a wrapping mechanism axis 50. A third driver, a wrap bar carrier driver 30 shown supported by one of frame elements or station legs 12 (FIG. 1), is operatively linked, via a common shaft 31 and otherwise indirectly as shown (e.g., FIG., 2, and especially FIGS. 3-5) as will be later detailed, to wrap bar carrier 44.

It should be understood, and readily appreciate with reference to the figures and in the context of the entirety of the instant disclosure, that the referenced drivers and drive assemblies may be adapted in known ways, even functionally consolidated, to nonetheless drive select elements or station subassemblies in furtherance of the general aim of the wrapping station. Thus, in as much as the non-limiting drive depictions are believed advantageous, in the context of the wrapping mechanism contemplated and/or disclosed, it is only a requisite that: a wrapping conveyor or the like transport product through the station; a wrapping support structure be rotated about a wrapping mechanism axis so as to orbit about the wrapping conveyor; and, the wrapping support structure be radially translated or translatable relative to the wrapping mechanism axis during its orbit thereabout.

With general reference now to FIGS. 4-6, there is shown the preferred, non-limiting wrapping apparatus or mechanism 40 generally characterized by wrap bar carrier 44, rotatable carrier block 46 translatingly retaining wrap bar carrier 44, and drive assembly 48 operatively linked to wrap bar carrier 44 for selectively translating wrap bar carrier 44 in relation to carrier block 46 during driven rotation of wrap bar carrier 44. As will be subsequently further developed, carrier block 46 advantageously supports first and second driven elements, more particularly, and as shown, a fixedly supported driven element 52 in furtherance of carrier block rotation, and a rotatingly supported driven element 54 in furtherance of selectively translating the wrap bar carrier. The drive assembly 48 advantageously includes a fixed length element e.g., a flexible fixed length element such as a cable or wire rope 56 as shown, extending between or traversing opposing end portions of wrap bar carrier 44, and rotatingly supported driven element 54 supported by carrier block 46, the fixed length element in operative engagement therewith.

With regard to wrap bar carrier 44, which is disposed generally perpendicular to wrapping mechanism axis 50, it may be fairly characterized as an elongate, frame-like element having first and second opposing end portions delimited, as shown, by braces, brackets or crossbars 58. The carrier 44 preferably, but not necessarily, includes a pair of spaced apart members or elements, e.g., tubes 60 as shown, which are united and retained at their end portions/free ends by braces 58. It should be noted and appreciated that structures comprising a wrap bar carrier may be various or sundry. While a carrier comprised of a single element slidingly or otherwise received or receiveable by a rotatable block, or other variation on a structure adapted to retain at least a portion of a wrap bar and to translate in relation to a rotating or rotatable element with which it is associated, falls within the scope of this disclosure, the robustness of carrier 44 is believed especially advantageous and preferable.

The carrier braces 58 generally include an adaptation in furtherance of supporting an end/end portion of wrap bar 42, or the wrap bar at one end thereof, either directly, or indirectly such that wrap bar 42 extends therefrom, either directly or indirectly.

An indirect advantageous arrangement is generally shown wherein an arm, more particularly an offset arm 62, is provided to link wrap bar 42 to brace 58. With a pair of wrap bars so supported or carried by the braces of the wrap bar carrier, a distance or dimension between opposingly supported wrap bars ($D_{WB}$) exceeds a distance or dimension between opposing free ends of the wrap bar carrier ($D_{WBC}$), see e.g., FIG. 6.

The carrier braces 58 generally include a further adaptation for the retention of a free end portion of fixed length flexible element 56 of drive assembly 48. For instance, as shown in FIG. 4, braces 58 may include or be suitably equipped with cable stays or anchors 64 which receive and retain free end portions of cable 56. Moreover, with the given/depicted orientation of anchor stay 64 (i.e., horizontal as opposed to a likewise contemplated vertical orientation), the braces 58 further include, or are suitably equipped with, a roller pin 66 to alter or redirect cable 56 from an initial vertical extension to a horizontal extension in furtherance of traversing or spanning the length of wrap bar carrier 44.

With regard now to rotatable carrier block 46, which is carried for rotation upon a free end of table support tube 24 (e.g., FIG. 2 or 3), it fixedly supports driven element 52, e.g., a belt pulley or the like, upon a first block face (e.g., FIG. 5). The fixedly driven element 52 is operatively linked to carrier block driver 28, as shown for example in FIG. 2 or 3, in furtherance of selective rotation of the block, e.g., rotational velocity and/or acceleration changes (i.e., time varied or variable motions) in addition to starts and stops thereof, about wrapping mechanism axis 50, and thereby wrap bar 42 via wrap bar carrier 44.

The rotatable carrier block 46, which translatingly retains wrap bar carrier 44 intermediate the opposing end portions thereof, rotatingly supports driven element 54, of drive assembly 48, upon a second block face (e.g., FIG. 4). The rotatingly driven element 54 generally includes, in combination, a belt pulley 68 or the like, and a cable drum or spool 70 upon which cable 56, at least to some extent, is reversibly wound or taken up. The rotatingly driven element 54 is operatively linked to translation driver 30, as shown for example in FIG. 2 or 3, in furtherance of selective translation of wrap bar carrier 44 relative to carrier block 46, e.g., back and forth velocity and/or acceleration changes (i.e., time varied or variable motions) in addition to starts and stops thereof, and thereby, wrap bar 42 in relation to wrapping mechanism axis 50 (i.e., the selective establishment of a wrap bar travel path commensurate with the product profile of the product).

With continued general reference to FIGS. 4-6 and particular reference to FIGS. 4 & 6, the relationship between structures of drive assembly 48 are shown, more particularly, fixed length element 64 and driven element 54 rotatingly supported by carrier block 46. The cable 56, extending from one brace 58 to the other, is fixedly supported by or upon cable drum 70 of driven element 54. More particularly, cable drum 70 includes adjacent or spaced apart peripheral cable grooves 72 (e.g., FIG. 4) within which are received, and receivable, cable portions 56A, 56B. Moreover, intermediate the anchored cable ends, an offset cable center segment 56C is fastened or otherwise affixed to cable drum 70, e.g., by a zig-zag clamping plate 74 retained by fasteners 76 as shown in FIG. 6. Upon actuation of driven element 54 rotatingly supported by carrier block 46, up to one half of length of cable 56 spanning braces 58 may be wound/unwound from cable drum 70 to thereby effectuate translation of wrap bar carrier 44 relative to carrier block 46, i.e., to effectuate a sliding passage or the like of spaced apart carrier members or tubes 60 through rotatable carrier block 46.

As should be readily appreciated in light of the foregoing, the wrap bar may be quickly, reliably and efficiently directed radially while orbiting the conveyed product. Maximum and minimum radial extensions for wrap bar 42 relative to conveyed product P or wrapping mechanism axis 50 are generally delimited by $D_{WBC}$, or in the depicted apparatus arrangement, by $D_{WB}$ (FIG. 6), with select radial intermediate positions attainable via select rotation of driven element 54 rotatingly supported by carrier block 46. For example, in or with the intermediate arrangement of FIG. 6 (see also FIG. 1), wherein equivalent suspended cable lengths extend between braces 58 and driven element 54, a median wrap bar radius ($r_M$) for the orbit is defined. With the rotation of driven element 54 to the right in FIG. 6 (clockwise FIG. 1), to thereby take up the right side suspended cable, a maximum wrap bar radius ($r_{max}$) for the orbit is defined, and contrariwise, with rotation of driven element 54 to the left in FIG. 6 (counterclockwise FIG. 1), to thereby take up the left side suspended cable, a minimum wrap bar radius ($r_{min}$) for the orbit is defined.

While general preferences are noted with regard to the drive assembly of the wrapping apparatus of FIGS. 4-6, the wrapping table or system of FIG. 2 and the wrapping station of FIG. 1, some further observations are in order. More particularly, observations with regard to specific preferences in connection to the described and/or depicted assemblies, or subassemblies as the case may be, and suitable or contemplated alternative subassemblies or one or more elements of the outlined station, table or apparatus follows.

First, and in furtherance of increased and enhanced product processing, strength, durability and weight are appropriate general considerations. In furtherance thereof, it is believed advantageous to provide structural apparatus symmetry, e.g., paired wrap bar carrier members or tubes, paired wrap bars extending from opposing ends of the carrier members, and opposingly paired wrap bar carrier members between which the opposingly paired wrap bars extend. Moreover, while elements, subassemblies and assemblies may be fabricated using conventional materials, it is believed advantageous that the wrap bar comprise 7075 series aluminum, and that the table support member comprise a rigid 3.5" OD CRS tubing.

Second, it is to be emphasized that while alternate known mechanisms such as, and without limitation, a chain and sprocket, rack and pinion, telescoping element, robotic arm with two pivot motions, etc. may be available to effectuate a translation of a wrap bar carrier relative to a rotatable carrier block while nonetheless avoiding a slave/track system. The contemplated fixed length element, advantageously provided in the form of a 304 series stainless steel wire rope, provides for a supremely responsive and quick translation of the carrier, enabling heretofore unseen product throughput speeds of up to at least 150 cycles per minute.

Third, and finally, while the driven assemblies described benefit from a variable driven operation, they need not be so limited. Advantageously, well known variable operable drivers, such as a servo drive or stepper motor, are provided so as to impart time variable motions to their driven elements. With regard to wrap bar carrier translation, time variable selective translations, resulting in time variable radial motions of the wrapper bar, are achievable, with time variable motions or motion segments for the carrier block, resulting in time variable arcs or arcuate segments for the wrapper bar, and time variable motions or motion segments for the conveyor driver, resulting in time variable linear belt motions is likewise achievable.

Thus, since the assemblies, subassemblies, structures and/or elements, and processing steps disclosed directly or implicitly herein may be embodied in other specific forms without departing from the spirit or general characteristics thereof, some of which forms have been indicated, the features described and depicted herein/herewith are to be considered in all respects illustrative and not restrictive. Accordingly, the scope of the disclosed invention is as defined in the language of the appended claims, and is to include liberal, not insubstantial equivalents thereto.

That which is claimed is:

1. A wrapping apparatus for wrapping a product characterized by a product profile, the apparatus comprising:

a. a wrap bar for engaging and directing a wrapper about the product;

b. a wrap bar carrier having opposing first and second end portions, said wrap bar extending from said first end portion of said opposing first and second end portions;

c. a carrier block, translatingly retaining said wrap bar carrier intermediate said opposing end portions thereof, said carrier block drivingly rotatable about a wrapping axis of the apparatus so as to thereby rotatingly drive said wrap bar about said wrapping axis via rotation of said wrap bar carrier; and, d. a drive assembly, operatively linked to said wrap bar carrier, so as to translate said wrap bar carrier in relation to said carrier block during driven rotation of said wrap bar carrier, a radial distance for said wrap bar from said wrapping axis being thereby established in furtherance of delimiting a wrap bar travel path commensurate with the product profile of the product.

2. The wrapping apparatus of claim 1 wherein said carrier block fixedly supports a driven element in furtherance of carrier block rotation.

3. The wrapping apparatus of claim 1 further comprising a driven element, said driven element fixedly supported by said carrier block.

4. The wrapping apparatus of claim 1 wherein said carrier block rotatingly supports a driven element in furtherance of selectively translating said wrap bar carrier.

5. The wrapping apparatus of claim 1 wherein said drive assembly includes a driven element, said driven element rotatingly supported by said carrier block.

6. The wrapping apparatus of claim 1 wherein said carrier block fixedly supports a first driven element, and rotatingly supports a second driven element.

7. The wrapping apparatus of claim 1 wherein said drive assembly comprises a fixed length element extending between said opposing end portions of said wrap bar carrier.

8. The wrapping apparatus of claim 1 wherein said drive assembly comprises a fixed length flexible element in extension between said opposing end portions of said wrap bar carrier.

9. The wrapping apparatus of claim 1 wherein said drive assembly comprises a looped fixed length flexible element extending between said opposing end portions of said wrap bar carrier.

10. The wrapping apparatus of claim 1 wherein said drive assembly comprises a driven element and a fixed length flexible element supported thereby, said fixed length flexible element fixedly extending between said opposing end portions of said wrap bar carrier.

11. The wrapping apparatus of claim 1 wherein said drive assembly comprises a rotatingly driven element extending from said carrier block, and a fixed length flexible element loopingly supported thereby, said fixed length flexible element spanning said opposing end portions of said wrap bar carrier.

12. The wrapping apparatus of claim 1 wherein said drive assembly comprises a looped fixed length flexible element extending between said opposing end portions of said wrap bar carrier, and a drum rotatingly supported by said carrier block about which a segment of said loop is fixedly received.

13. The wrapping apparatus of claim 1 wherein said drive assembly includes a driven element, rotatingly supported by said carrier block, and a fixed length flexible element spanning said opposing end portions of said wrap bar carrier.

14. The wrapping apparatus of claim 13 wherein said driven element includes a drum about which said fixed length flexible element loopingly extends.

15. The wrapping apparatus of claim 14 wherein an intermediate segment of said fixed length flexible element spanning said opposing end portions of said wrap bar carrier is affixed to said drum.

16. The wrapping apparatus of claim 15 further comprising a variable output driver, said variable output driver operatively linked to said driven element in furtherance of effectuating selective translation of said wrap bar carrier in relation to said carrier block.

17. The wrapping apparatus of claim 1 further comprising a further wrap bar, said further wrap bar extending from said second end portion of said opposing first and second end portions of said wrap bar carrier.

18. The wrapping apparatus of claim 1 further comprising a driver for rotatingly driving said carrier block about said wrapping axis.

19. The wrapping apparatus of claim 1 further comprising a variable speed driver for rotatingly driving said carrier block about said wrapping axis.

20. The wrapping apparatus of claim 1 further comprising a driver for selectively translating said wrap bar carrier in relation to said carrier block during driven rotation of said elongate wrap bar carrier.

21. The wrapping apparatus of claim 1 further comprising a variable speed driver for selectively translating said wrap bar carrier in relation to said carrier block during driven rotation of said elongate wrap bar carrier.

22. The wrapping apparatus of claim 1 further comprising a first driver for rotatingly driving said carrier block about said wrapping axis, and a second driver for selectively translating said wrap bar carrier in relation to said carrier block during driven rotation of said wrap bar carrier.

23. The wrapping apparatus of claim 1 in operative combination with a product conveying system so as to define a wrapping table over which said wrap bar travels.

24. Wrapping apparatus for automated sheet wrapping of a conveyed product comprising:

a. a wrap supporting member;

b. opposingly paired, spaced apart elongate wrap bar carriers, said wrap supporting member exclusively supported by corresponding free end portions of said opposingly paired elongate wrap bar carriers in furtherance of establishing a trackless travel path for said wrap supporting member about a wrapping axis; and, c. opposingly paired, spaced apart, and synchronously rotatable retainers, each retainer of said opposingly paired retainers reciprocally retaining each elongate wrap bar carrier of said opposingly paired elongate wrap bar carriers to thereby establish a select driven radial position of said wrap support member relative to said wrapping axis during travel of said wrap supporting member along said trackless travel path.

25. A wrapping apparatus for wrapping a product characterized by a product profile, the apparatus comprising:

a. a wrap bar for engaging and directing a wrapper about the product;

b. a wrap bar carrier having opposing first and second end portions, said wrap bar extending from said first end portion of said opposing first and second end portions;

c. a carrier block translatingly retaining said wrap bar carrier and driven for rotation about a wrapping axis of the apparatus so as to thereby rotatingly drive said wrap bar about said wrapping axis via rotation of said wrap bar carrier; and, d. a drive assembly operatively linked to said wrap bar carrier so as to drivingly translate said wrap bar carrier in relation to said carrier block during driven rotation of said wrap bar carrier, a radial distance for said wrap bar from said wrapping axis being thereby established in furtherance of delimiting a wrap bar travel path commensurate with the product profile of the product.

26. A wrapping apparatus for wrapping a product characterized by a product profile, the apparatus comprising:

a. a wrap bar for engaging and directing a wrapper about the product;

b. a wrap bar carrier having opposing first and second end portions, said wrap bar extending from said first end portion of said opposing first and second end portions;

c. a carrier block translatingly retaining said wrap bar carrier and driven for rotation about a wrapping axis of the apparatus so as to thereby rotatingly drive said wrap bar about said wrapping axis via rotation of said wrap bar carrier; and, d. a wrap bar translation assembly comprising a rotatingly driven element and a fixed length element operated upon thereby, said rotatingly driven element united with said carrier block so as to rotate therewith, said fixed length element extending between said opposing end portions of said wrap bar carrier, select reversible rotation of said rotatingly driven element of said wrap bar translation assembly during rotation of said carrier block about said wrapping axis effectuating driven translation of said wrap bar carrier, a radial distance for said wrap bar from said wrapping axis being thereby established in furtherance of delimiting a wrap bar travel path commensurate with the product profile of the product.

27. Apparatus comprising:

a. a wrap bar for engaging and directing placement of a wrapper;

b. a wrap bar carrier, said wrap bar supported from an end portion of said wrap bar carrier so as to extend therefrom;

c. a rotatable carrier block driven for rotation about a wrapping axis of the apparatus, said wrap bar carrier translatingly retained by said rotatable carrier block so as to reversibly travel with respect thereto; and, d. a drive assembly operatively linked to said rotatable carrier block so as to drivingly translate said wrap bar carrier in relation to said rotatable carrier block, select driven translation of said wrap bar carrier in relation to said rotatable carrier block during driven rotation of said rotatable carrier block about said wrapping axis of the apparatus thereby delimiting a user select wrap bar travel path about said wrapping axis characterized by non-constant radial distance for said wrap bar from said wrapping axis.

* * * * *